US006427572B2

(12) United States Patent
Ciani et al.

(10) Patent No.: US 6,427,572 B2
(45) Date of Patent: Aug. 6, 2002

(54) CIRCULAR TOOL FOR CUTTING ROLLS OF PAPER AND SIMILAR

(76) Inventors: Tristano Ciani, Via S. Pelagio, 75-33019, Tricesimo (UD) (IT); Michele Pironti, Via dei Gatari, 13-35100, Padova (IT); Rodolfo Taverna, Via Moletolo, 82-43100, Parma (IT)

( * ) Notice: Subject to any disclaimer, the term of this patent is extended or adjusted under 35 U.S.C. 154(b) by 0 days.

(21) Appl. No.: 09/801,145

(22) Filed: Mar. 7, 2001

Related U.S. Application Data

(63) Continuation of application No. PCT/IB99/01508, filed on Sep. 3, 1999.

(30) Foreign Application Priority Data

Sep. 7, 1998 (IT) ..... UD98A0153

(51) Int. Cl.[7] ..... B26D 1/14
(52) U.S. Cl. ..... 83/676; 83/663; 83/675
(58) Field of Search ..... 83/676, 663, 675, 83/113, 105, 932; 30/347, 350, 357; 76/115, DIG. 6

(56) References Cited

U.S. PATENT DOCUMENTS 1,198,314 A * 9/1916 Baude ..... 76/115
1,468,905 A * 9/1923 Herman ..... 428/610
3,292,478 A * 12/1966 Falk et al. ..... 30/679
3,299,925 A * 1/1967 McBrady ..... 83/676
3,308,703 A * 3/1967 Sauer ..... 83/676
3,411,208 A * 11/1968 Malm ..... 30/350
3,812,755 A * 5/1974 Danielsen ..... 83/835
3,990,338 A * 11/1976 Wikner et al. ..... 83/835
4,167,132 A * 9/1979 Zontelli ..... 83/676
4,187,754 A * 2/1980 Beaty ..... 83/847
5,297,637 A * 3/1994 Rowlett ..... 172/604
5,988,033 A * 11/1999 Skaar et al. ..... 83/596

* cited by examiner

*Primary Examiner*—M. Rachuba
*Assistant Examiner*—Kim Ngoc Tran
(74) *Attorney, Agent, or Firm*—Akin, Gump, Strauss, Hauer & Feld, L.L.P.

(57) ABSTRACT

Circular tool (10) for cutting rolls of paper and similar, the tool (10) including a central axial hole (11), two lateral surfaces (10*a*) and an outer cutting edge (12) defined by two chamfers or bevels (13*a*, 13*b*) inclined at respective angles "α,β" with respect to the lateral surfaces (10*a*), one chamfer (13*a*) defining a cutting side of the tool (10) and the other chamfer (13*b*) defining a side not directly involved in the cutting action of the tool (10), the tool (10) being able to be associated by means of the central hole (11) with a rotation shaft, the lateral surfaces (10*a*) having a thickness "s" of between 2 and 4 mm and being parallel to each other, the surface defined by the chamfer (13*b*) not directly involved in the cutting action being covered with a protective layer (14) of material of great hardness.

15 Claims, 1 Drawing Sheet

CIRCULAR TOOL FOR CUTTING ROLLS OF PAPER AND SIMILAR

CROSS-REFERENCE TO RELATED APPLICATION

This application is a continuation of International Application No. PCT/IB99/01508 filed Sep. 3, 1999, the disclosure of which is incorporated herein by reference.

FIELD OF THE INVENTION

This invention concerns a circular tool for cutting rolls of paper and similar as set forth in the main claim.

The tool according to the invention is used in cutting machines employed in the paper industry to cut transversely the reel of paper so as to obtain rolls of defined length and diameter.

A particular, though not exclusive, application of the invention is to use the tool for the cyclical cutting of rolls of toilet paper or absorbent paper for domestic use.

BACKGROUND OF THE INVENTION

The state of the art includes cutting machines used in the paper industry to subdivide the reels of paper into several rolls of a desired length.

These machines are usually equipped with one or more rotary tools, or disks, which have a sharp circumference and are keyed onto a supporting shaft equipped with gripping flanges.

These machines are suitable to transmit to the supporting shafts of the disks both a rotation movement around the relative axis, and also a revolving movement in order to sequentially cut the reels of paper which are fed forwards linearly in correspondence with the revolving circumference of the disks.

Cutting disks known in the state of the art have a transverse section which is symmetrical with respect to a median longitudinal plane and is defined by a first brief inner segment, astride the axis of rotation of the tool, substantially plane and suitable to cooperate with the gripping flanges, and by a second outer segment, slightly wedge-shaped.

The top of said second outer segment is sharpened on both sides by means of symmetrical bevelling, or chamfering, of an extremely limited angle, in the order of about 8° or a little more.

An example of such conventional cutting tools is shown in DE-A-39 06 026, which discloses the features of the preamble of claim 1.

These disks usually have a diameter of around 600 mm, or more, and a thickness of around 5 mm: they are required to perform up to 800 strikes, or cuts, a minute, which compromises the sharpness and therefore the productivity of the tool.

Therefore, such blades need frequent sharpening, and this is usually done in line by means of pairs of grinding elements arranged in "V"s and suitable to restore the sharpness to the cutting edge of the disk.

The grinding elements do not have their own drive and are taken into rotation under pressure from the rotation movement of the tools themselves.

However, re-sharpening the cutting edge in this way is not very efficient, inasmuch as it is very difficult to center the grinding elements and in the long term it may make the disk slightly elliptic, which compromises the accuracy of the cutting action.

Moreover, the re-sharpening carried out by these grinding elements, also because of the great pressure exerted thereby, makes the edge of the cutting blade very jagged, often causes imperfections in the cut section of the roll of paper, and leads to a rapid deterioration of the tool.

The jaggedness of the edge compromises the cutting efficiency of the tool, especially when cutting rolls of padded paper or such like: such paper is very delicate to cut and requires extremely sharp tools to obtain high quality results.

Moreover, since the re-sharpening process is usually repeated every 50 strikes, or cuts, according to the type of paper to be cut, it entails a premature wear of the disks, a need to replace them rapidly and therefore an increase in the management costs of the cutting machines.

One shortcoming which businessmen in this field especially complain of is the poor quality of the geometry of the cut, owing in particular to the prevalently wedge-shaped conformation of the disk.

This wedge-shaped conformation is required by the large diameter and thickness of the disks, and causes considerable pressure on the cut edge of the roll; this often generates a cut which is not at right angles and deforms the edge of the roll.

A further disadvantage is that conventional tools employed in the field of cutting rolls of paper, such as for example the tool described in DE'026 or that described in DE-C-196 16 678, are lined with protective material on both sides, which entails the need to provide a new lining after every sharpening operation because the lining is removed precisely during the sharpening operation.

EP-A-628.379 describes a cutting tool for use with food products, with a transverse section substantially symmetrical with respect to a median axis and with a cutting profile lined on one side only by protective material.

This tool is not suitable to cut products such as rolls of paper, which require a very sharp edge.

Moreover, the symmetry of the section gives it an extremely short life, since after only a few sharpening operations the cutting profile is removed to such a point that the tool is unusable and has to be replaced.

The present applicants have devised and embodied this invention to overcome these disadvantages.

BRIEF SUMMARY OF THE INVENTION

The invention is set forth and characterised in the main claim, while the dependent claims describe other characteristics of the main embodiment.

The purpose of the invention is to provide a circular tool, or disk, to cut rolls of paper and suitable to make cuts with an extremely precise profile, perfectly orthogonal to the longitudinal axis of the roll and without deforming the cut edge of the roll, particularly rolls of padded paper or similar.

Another purpose of the invention is to drastically increase the working life of the tool, and thus reduce the management costs of the cutting machines and increase their productivity.

A further purpose is to obtain a tool which will be reliable even mounted on a machine, which will require much less frequent sharpening operations compared with conventional tools and which will keep its cutting characteristics intact even after a plurality of sharpening operations.

The circular tool according to the invention has a transverse section defined by two lateral surfaces which are not wedge-shaped, but are parallel to one another.

In this way, during the cutting step, any lateral pressure on the edge of the roll is eliminated and therefore the resulting cut is perfectly orthogonal with respect to the longitudinal axis of the roll. Moreover, the edge of the roll is not deformed by the cutting action.

The outer cutting edge of the circular tool is defined by two bevels, or chamfers, present on both sides of the edge.

In the preferential embodiment of the invention, the chamfers have an inclination of between 6° and 10° with respect to the longitudinal median plane of the disk.

In an even more preferential embodiment, the chamfers have an inclination of an angle of around 8° with respect to the longitudinal median plane of the disk.

According to one characteristic of the invention, only one of the two surfaces defined by the chamfers, that is to say, the one which is not directly concerned with cutting, is covered with a protective layer made of an extremely hard material such as, for example, a nitride.

In this way, the cutting edge is maintained much longer compared with tools known to the state of the art, since it is defined, on one side, by this layer of very hard material.

Moreover, this cover lasts much longer in that the chamfered side which is subjected to sharpening is the one which is not covered, and therefore the sharpening operation does not remove the covering layer.

According to another characteristic of the invention, the chamfers are asymmetrical with respect to the longitudinal median plane of the tool.

In a preferential embodiment, a first chamfer, that is to say, the one not lined with protective material, is made on about one third of the thickness of the tool, and the other chamfer, that is to say, the one which is lined, is made on about the remaining two thirds of the thickness.

This asymmetry, wherein the narrowest part of the profile comprises, at least initially, the side of the tool which is used for cutting, prolongs the working life of said tool.

In fact, the sharpening operations made on the cutting side, by progressively removing material from the outer edge of the tool, progressively displace the asymmetry until the cutting profile is first made symmetrical and then asymmetrical in a specular manner with respect to the initial profile.

This configuration, together with the less frequent sharpening operations, means that the tool can be used for a much larger number of cutting cycles compared with tools known to the state of the art.

In a first embodiment of the invention, the tool is made of high speed steels while, according to a variant, it is made of powder steel.

The tool according to the invention, in its preferential embodiment, has an outer diameter of between 500 and 550 mm.

In an even more preferential embodiment, the tool has an outer diameter of around 530 mm.

The smaller diameter compared with tools such as are known to the state of the art makes possible to achieve tools with parallel walls, not tapered, and also to use a much reduced thickness, of between 2 and 4 mm, advantageously in the range between 2.8 and 3.2 mm, without any danger of the tool bending during the cutting action.

The fact that the lateral surfaces of the tool are parallel, and the reduced thickness of the tool, make possible to achieve very accurate cuts, perfectly orthogonal to the longitudinal axis of the roll.

The reduced thickness also allows to reduce the friction and pressure between the tool and the paper, which gives the advantage of cleaner cuts and less effort required for the drive means of the cutting machine.

According to a variant of the invention, used particularly with tools of limited diameter and for cutting particular types of paper, at least one of the lateral surfaces of the tool has a concave segment, which allows to further reduce friction and to prevent deviations in the cutting and jagged edges in the paper; this is thanks to the reduced pressure which the tool exerts on the cut edge of the roll in correspondence with the said concave segment.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

These and other characteristics of the invention will become clear from the following description of a preferred form of embodiment, given as a non-restrictive example, with reference to the attached drawings wherein.

DETAILED DESCRIPTION OF THE INVENTION

Figure 1:
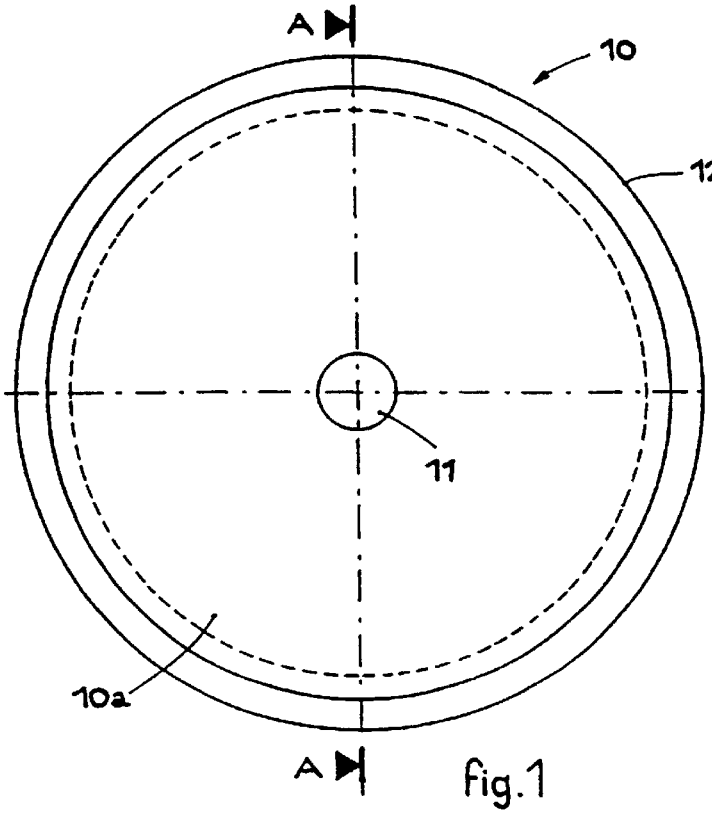
FIG. 1 is a side view of a circular tool according to the invention to cut rolls of paper.

With reference to the attached figures, a circular tool 10 according to the invention has axially a central hole 11 suitable to allow the tool 10 to be keyed, substantially in a known manner by means of clamping flanges, onto a supporting shaft of a cutting machine which is not shown here.

The cutting machine is preferentially of the cyclical type employed for the precision cutting of rolls of paper, for example toilet paper of the padded type or similar.

According to the invention the tool 10 is defined by two lateral surfaces 10*a* which are parallel to each other; it has an outer cutting edge 12 defined at least by two chamfers 13 made on the respective circumferential edges of the said lateral surfaces 10*a*.

According to the invention, the chamfers 13 define an angle a with respect to the respective lateral surface 10*a*, between 6° and 10°, advantageously around 8°.

In this case, a first chamfer 13*a* is defined on one third of the thickness "s" of the tool and the other chamfer 13*b* is defined on the remaining two thirds of the same thickness "s".

According to the invention, the chamfer 13*a* defines the cutting side of the tool 10, that is to say the side which acts directly on the roll of paper which is to be cut, and which periodically has to be re-sharpened to restore the edge which becomes worn after a plurality of cutting cycles.

The asymmetrical nature of the chamfer prolongs the working life of the tool, in that it allows it to be used until the asymmetry has been inverted from one side of the tool to the other, due to the progressive consumption caused by the cutting operations and by the successive re-sharpening operations.

This configuration allows the tool to be used much longer than traditional tools with a symmetrical chamfer.

According to the invention, the chamfer 13*b* made on two thirds of the thickness "s" and on the side not directly involved in the cutting operations is covered with a protective layer 14 of material characterised by great hardness such as, for example, titanium, chrome, or aluminium nitride, or similar.

In this way, the cutting edge 12 is defined, on one side, by this protective layer 14 and on the other side by a chamfer 13*a* which can be periodically sharpened.

The protective layer 14, which performs a function of structural reinforcement, allows to maintain the cutting edge 12 for a longer period, with the advantage that sharpening operations can be carried out less frequently, and therefore the working life of the tool 10 is longer than that of tools such as are known to the art; this working life is, moreover, even further prolonged by the asymmetrical chamfer.

Figure 2:
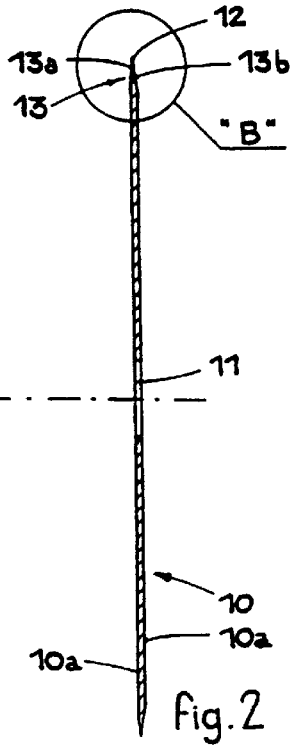
FIG. 2 shows the cross section from A to A of FIG. 1.
Figure 3:
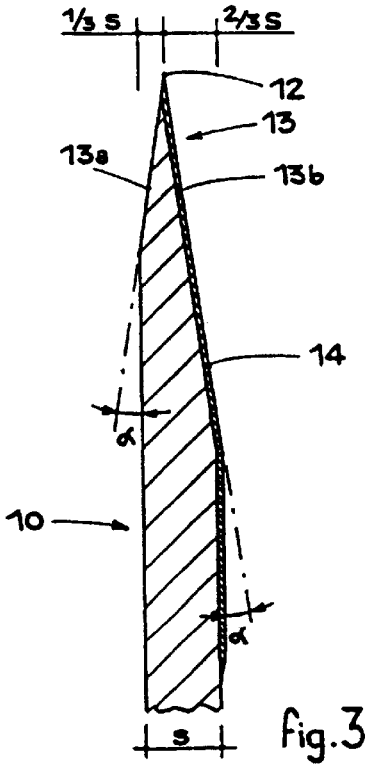
FIG. 3 shows, in a first preferential embodiment, the enlarged detail B of FIG. 2.

FIGS. 1–3 show a tool 10 wherein the lateral faces 10*a* are parallel to each other and define a thickness "s", in the preferential embodiment between 2 and 4 mm, advantageously between 2.8 mm and 3.2 mm.

In the preferential embodiment of the invention, the outer diameter of the tool 10 is between 500 mm and 550 mm, advantageously 530 mm.

Figure 4:
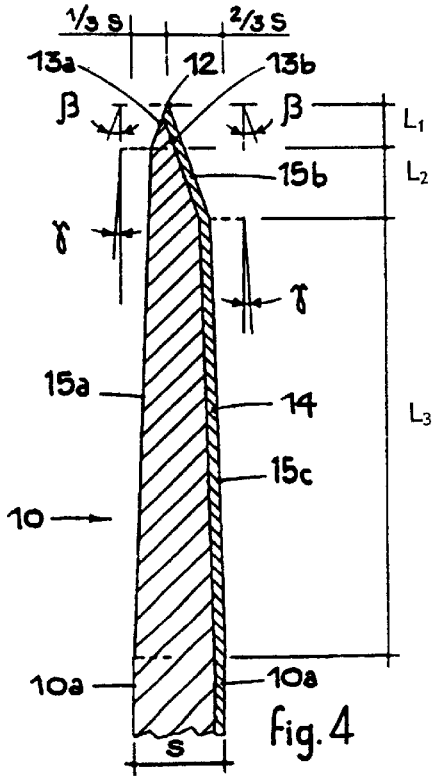
FIG. 4 shows another preferential embodiment of the invention with a variant of FIG. 3.

The variant shown in FIG. 4 shows a cutting tool 10 in which the outer cutting edge 12 comprises a pair of chamfers 13*a* and 13*b* which are asymmetrical with respect to a longitudinal median plane and inclined by an angle β of around 8° with respect to the said median plane.

The chamfers 13*a* and 13*b* extends for a height "L1" of around 2 mm with respect to the outer edge 12 of the tool 10.

The left chamfer 13*a,* which occupies about ⅓ of the thickness "s" of the tool 10 and constitutes the cutting side, is not covered with protective material and extends with a segment 15*a* inclined by an angle γ of around 2–3° and then continues with the parallel segment 10*a*.

The right chamfer 13*b,* which occupies ⅔ of the thickness "s" of the tool 10, is lined with the protective layer 14 and extends without any variation in its inclination with a segment 15*b,* which is therefore also inclined by an angle β of about 8° with respect to the longitudinal median plane of the tool 10.

This segment 15*b* extends for a height "L2" of about 10–12 mm from the outer edge 12 of the tool 10.

The segment 15*b* then varies the inclination and continues with a segment 15*c* which is also inclined by an angle γ of about 2–3°, like the corresponding segment 15*a,* to a height "L3" of around 26–30 mm from the outer edge 12.

Like the segment 15*a,* the segment 15*c* then also continues with the parallel segment 10*a*.

This asymmetrical conformation with broken lines is suitable to guarantee a further extension of the working life of the tool 10 since, as the cutting chamfer 13*a* is progressively sharpened, the inclination of the segment 15*a* is progressively modified and, as the cutting tool 10 is gradually consumed, assumes a value equal to angle β.

The width of the tool 10 in correspondence with the segments 15*a* and 15*c,* with both sides inclined by an angle of γ, is preferentially equal to about 2.5 mm.

According to a further embodiment which is not shown here, on the two lateral surfaces 10*a* there are two concave segments suitable to reduce the friction and the pressure which exist between the lateral surfaces 10*a* and the superimposed layers of paper of the roll, during the cutting operation.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A circular tool (10) for cutting comprising a central axial hole (11), two lateral surfaces (10*a*) and an outer cutting edge (12) defined by two chamfers or bevels (13*a,* 13*b*) inclined at an angle (α or β) with respect to the lateral surfaces (10*a*), one chamfer (13*a*) defining a cutting side of the tool (10) and the other chamfer (13*b*) defining a side not directly involved in the cutting action of the tool (10), the tool (10) being able to be associated by means of the central hole (11) with a rotation shaft, the lateral surfaces (10*a*) having a thickness "s" therebetween of between 2 and 4 mm and being parallel to each other, wherein only the surface defined by the chamfer (13*b*) not directly involved in the cutting action is covered with a protective layer (14) of material of great hardness, whereas the surface defined by the chamfer (13*a*) involved in the cutting action is not covered with a protective layer (14), said chamfers (13*a,* 13*b*) being initially asymmetrical with respect to the longitudinal median plane of the tool, in which the initial value of the thickness of the chamfer (13*b*) not directly involved in the cutting action is greater than the thickness of the chamfer (13*a*) defining the cutting side of the tool.

2. The tool as in claim 1, wherein the chamfer (13*a*) defining the cutting side of the tool develops on one third of the thickness "s" and the other chamfer (13*b*) not directly involved in the cutting action develops on the remaining two thirds of the thickness "s".

3. The tool as in claim 1, wherein the thickness "s" is between 2.8 and 3.2 mm.

4. The tool as in claim 1, wherein the tool (10) has an outer diameter of between 500 mm and 550 mm.

5. The tool as in claim 4, wherein the tool (10) has an outer diameter of 530 mm.

6. The tool as in claim 1, wherein the chamfers or bevels (13*a,* 13*b*) are inclined at an angle of between about 6° and 10° with respect to the lateral surfaces (10*a*).

7. The tool as in claim 6, wherein the angle (α or β) is about 8°.

8. The tool as in claim 1, wherein the protective layer (14) is made of nitride.

9. The tool as in claim 1, wherein the chamfers (13*a,* 13*b*) have a height ("L1") with respect to the outer edge (12) of 2 mm.

10. The tool as in claim 1, wherein the chamfer (13*a*) defining the cutting side of the tool (10) is connected with one of the lateral surfaces (10*a*) by means of a segment (15*a*) inclined by an angle (γ) of 2–30°, while the chamfer (13*b*) defining the side not directly involved in the cutting action is connected to one of the lateral surfaces (10*a*) first by means of a segment (15*b*) inclined by an angle (β) of about 8° and then by a segment (15*c*) inclined by an angle (γ) of 2–3°.

11. The tool as in claim 10, wherein the height ("L2") of the inclined segment (15*b*) with respect to the outer edge (12) is 10–12 mm.

12. The tool as in claim 10, wherein the height ("L3") of the inclined segment (15*a*) with respect to the outer edge (12) is 26–30 mm.

13. The tool as in claim 1, wherein at least one of the lateral surfaces (10*a*) includes a concave portion.

14. The tool as in claim 1, wherein the tool (10) is made of high speed steels.

15. The tool as in claim 1, wherein the tool (10) is made of powder steels.

* * * * *